US007686082B2

(12) United States Patent
Marsh

(10) Patent No.: US 7,686,082 B2
(45) Date of Patent: Mar. 30, 2010

(54) FULL BORE CEMENTABLE GUN SYSTEM

(75) Inventor: Roger J. Marsh, Palmyra (AU)

(73) Assignee: Baker Hughes Incorporated, Houston, TX (US)

( * ) Notice: Subject to any disclaimer, the term of this patent is extended or adjusted under 35 U.S.C. 154(b) by 84 days.

(21) Appl. No.: 12/050,691

(22) Filed: Mar. 18, 2008

(65) Prior Publication Data

US 2009/0236094 A1 Sep. 24, 2009

(51) Int. Cl.
*E21B 33/13* (2006.01)
*E21B 43/11* (2006.01)

(52) U.S. Cl. ..... 166/286; 166/55.1; 166/285; 166/290; 166/376; 166/382

(58) Field of Classification Search ..... 166/281, 166/285, 286, 290, 297, 298, 376, 382, 55, 166/55.1, 177.4
See application file for complete search history.

(56) References Cited

U.S. PATENT DOCUMENTS

| | | | | | |
|---|---|---|---|---|---|
| 2,669,928 | A | | 2/1954 | Sweetman | |
| 2,837,164 | A | * | 6/1958 | Allen et al. | 166/292 |
| 3,277,961 | A | * | 10/1966 | Bohn | 166/297 |
| 3,706,344 | A | * | 12/1972 | Vann | 166/297 |
| 4,480,690 | A | * | 11/1984 | Vann | 166/250.07 |
| 4,564,076 | A | * | 1/1986 | Vann et al. | 175/4.52 |
| 4,637,468 | A | | 1/1987 | Derrick | |
| 4,709,760 | A | * | 12/1987 | Crist et al. | 166/285 |
| 5,361,843 | A | * | 11/1994 | Shy et al. | 166/297 |
| 5,372,193 | A | | 12/1994 | French | |
| 5,390,742 | A | * | 2/1995 | Dines et al. | 166/297 |
| 5,829,538 | A | | 11/1998 | Wesson et al. | |
| 6,062,310 | A | * | 5/2000 | Wesson et al. | 166/297 |
| 6,152,224 | A | | 11/2000 | French | |
| 6,220,355 | B1 | * | 4/2001 | French | 166/297 |
| 6,230,808 | B1 | | 5/2001 | French et al. | |
| 6,286,594 | B1 | | 9/2001 | French | |
| 6,289,991 | B1 | | 9/2001 | French | |
| 7,000,699 | B2 | | 2/2006 | Yang et al. | |
| 7,114,564 | B2 | | 10/2006 | Parrott et al. | |
| 7,195,066 | B2 | | 3/2007 | Sukup et al. | |
| 2002/0162657 | A1 | * | 11/2002 | Tumlin et al. | 166/285 |
| 2003/0230406 | A1 | * | 12/2003 | Lund | 166/278 |

FOREIGN PATENT DOCUMENTS

| | | | |
|---|---|---|---|
| GB | 2332920 | A | 7/1999 |

* cited by examiner

*Primary Examiner*—George Suchfield
(74) *Attorney, Agent, or Firm*—Steve Rosenblatt

(57) ABSTRACT

A completion method delivers cement to an open hole below a cemented casing. A gun or guns are run below a liner and a hanger and advanced into the cement before it sets up. With the gun and the liner surrounded in cement up to close to the hanger that supports the liner to the already cemented casing, the cement is allowed to set around the gun with no tubular surrounding the gun. The gun carries extra shot to enhance the perforation and can be fluid filled with clean fluid. Prior well cleaning such as with brine circulation is now limited to the region of the hanger and above. Production flow is through the perforations into the gun body allowing any residue of the explosive charge used to perforate to flow to surface.

20 Claims, 4 Drawing Sheets

FULL BORE CEMENTABLE GUN SYSTEM

FIELD OF THE INVENTION

The field of this invention is completion techniques and more particularly involving perforating through cement without a cemented casing, liner or other tubular in situ.

BACKGROUND OF THE INVENTION

Typically completions involve running in casing or hanging a liner and cementing it into position in the wellbore. Before running in a perforating gun the wellbore is generally circulated clean with brine so that the well is reasonably free of debris before the guns are set off. This circulation process can take days and is quite costly. Beyond that the casing or liner that is run in and cemented limits the gun size that can be run through it and that, in turn, limits the shot density in the gun.

If a tube or passage, of sufficient cross sectional area to deliver cement to the borehole below the gun, were placed inside the gun, the space it occupied would restrict the volume available for perforating charges. This would compromise the quality of the perforations and thereby the well performance would be degraded.

Existing techniques of perforating through cemented casing or liner or dealing with other aspects of perforating gun design can be seen in U.S. Pat. Nos. 2,669,928; 4,637,468; 7,000,699; 7,114,564; 7,195,066.

The present invention seeks to avoid the design constraints of prior systems by delivering a gun or guns below a tubular that is supported off existing casing with a hanger. The cement, or other fluid or material for hydraulic isolation and mechanical support, is first delivered in open hole and is formulated to allow enough time to run in with the gun or guns below a liner that has a hanger associated with it. The gun and liner displace cement to the annular space around the liner and preferably below the hanger. The gun or guns are fired once the surrounding cement or other fluid or material has set. The gun may be larger than in prior designs because the cemented liner in which the gun had to be advanced is no longer there. Furthermore, cleaning the debris from the well with circulation of brine can now be limited to the region above the hanger and doesn't need to extend deeper to where the gun or guns will be positioned when shot. These and other advantages of the present invention will be more readily apparent to those skilled in the art from a review of the description of the preferred embodiment and the associated drawings while understanding that the full scope of the invention is given by the appended claims.

SUMMARY OF THE INVENTION

A completion method delivers cement or other fluid or material for hydraulic isolation and mechanical support to an open hole below a cemented casing. A gun or guns are run below a liner and a hanger and advanced into the cement or other fluid or material before it sets up. With the gun and the liner surrounded in cement or equivalent fluid or material up to close to the hanger that supports the liner to the already cemented casing, the cement or equivalent fluid or material is allowed to set around the gun with no tubular surrounding the gun. The gun is able to convey larger and/or more charges to enhance the perforation because there is no cemented casing between the gun and the formation. The gun might be fluid filled with clean fluid or with air at atmospheric pressure depending on the nature of the internal gun components. An example of one of the types of gun which could be used is in the link gun in which the charges are secured in zinc rings which are pinned together. When the gun fires, the zinc rings disintegrate leaving the internal volume of the "gun body" clear for production. Prior well cleaning such as with brine circulation is now limited to the region of the hanger and above. The guns are fired and the internal components shatter to small fragments and/or a soluble powder. Production flow is through the perforations into the empty gun body. The residue of the explosive charges used to perforate the well are able to drop to the bottom of the gun (a blank section can be included to accommodate this residue) or can be produced to surface. Gun lengths that are longer than currently run on (mechanical or electrical) wireline can be employed.

DETAILED DESCRIPTION OF THE PREFERRED EMBODIMENT

Figure 1:
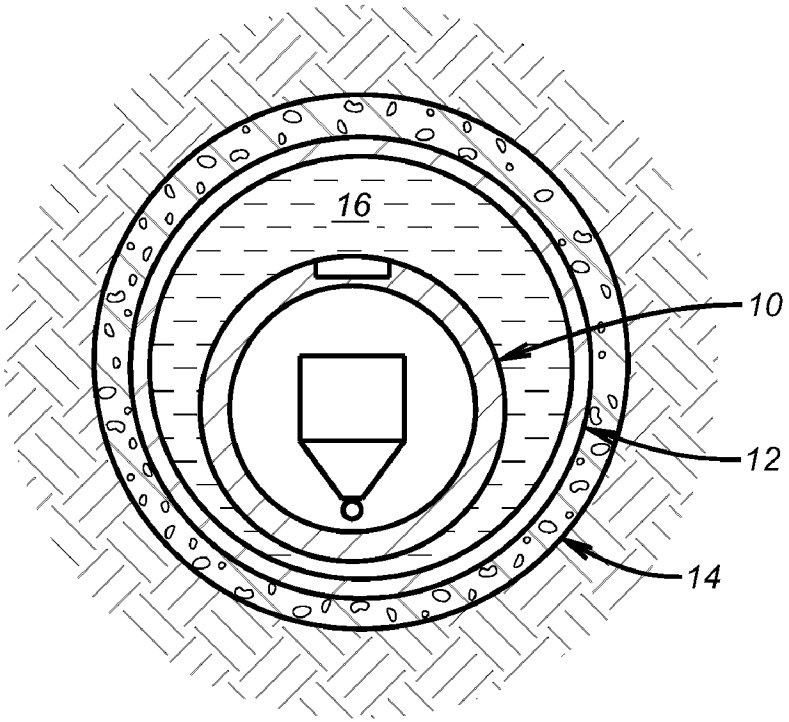
(PRIOR ART) FIG. 1
FIG. 1 is a section view through a cemented casing into which the perforating gun has been run in a manner known in the art.

FIG. 1 illustrates the known way of completion where a perforating gun 10 is run through a casing or tubular 12 that has been cemented 14. To fit through the tubular 12 the gun or guns have to be dimensionally smaller. The guns 10 when fired have to penetrate the tubular 12. Long periods of brine circulation are needed to get the debris out of the tubular string 12 so that there is a brine solution 16 surrounding the gun 10 when it is introduced into the wellbore. The density of the shot used in the gun 10 is limited by its outer dimension limitation caused by the inside diameter of the tubular 12 though which the gun 10 is advanced before it is fired.

Figure 2:
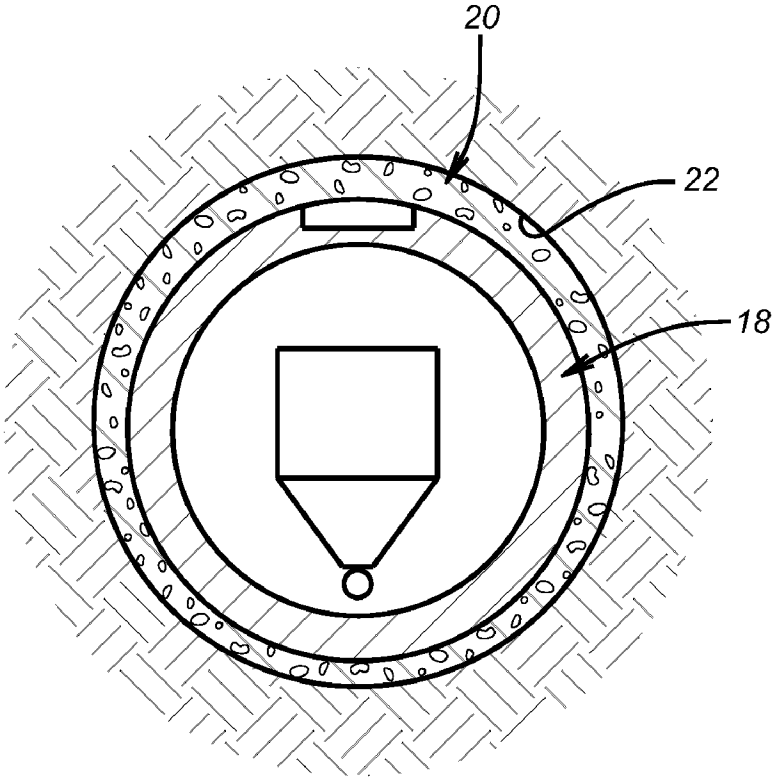
FIG. 2 is a section view showing a larger gun encased in cement with no surrounding tubular.
Figure 3:
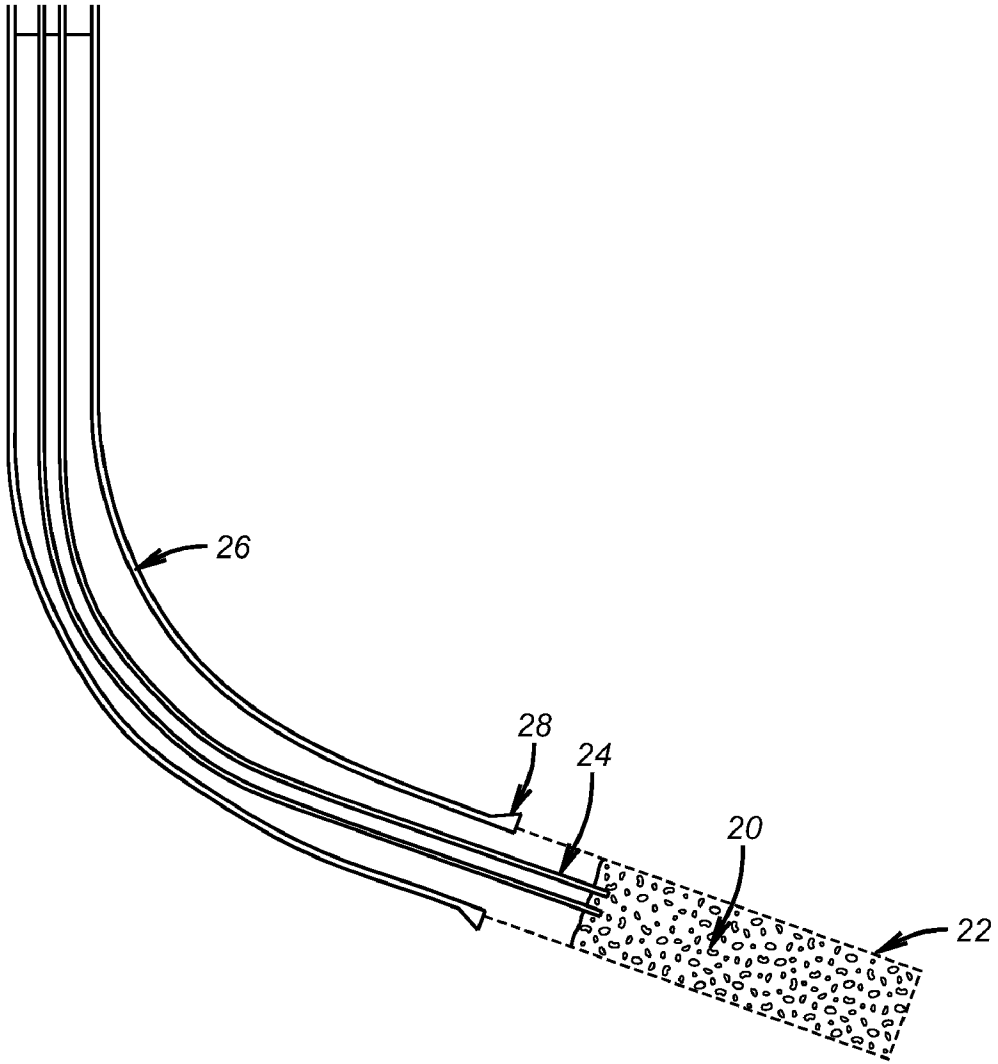
FIG. 3 is a section view showing the spotting of cement in open hole and in a sufficient quantity to displace some of that cement to the casing shoe when the gun or guns are delivered.

FIG. 2 illustrates the present invention and is better understood when looked at in conjunction with FIG. 3. The gun 18 is far larger than gun 10 of FIG. 1 because the tubular 12 no longer surrounds the gun 18. Instead the gun 18 is advanced into delivered cement 20 in open hole 22. As seen in FIG. 3 a string 24 delivers the cement 20 through the casing 26 that had been cemented earlier. FIG. 3 illustrates the casing shoe 28 at the lower end of the casing 26. After the cement has been spotted in the open hole, the work string is retrieved and the gun and liner assembly made up.

Figure 4:
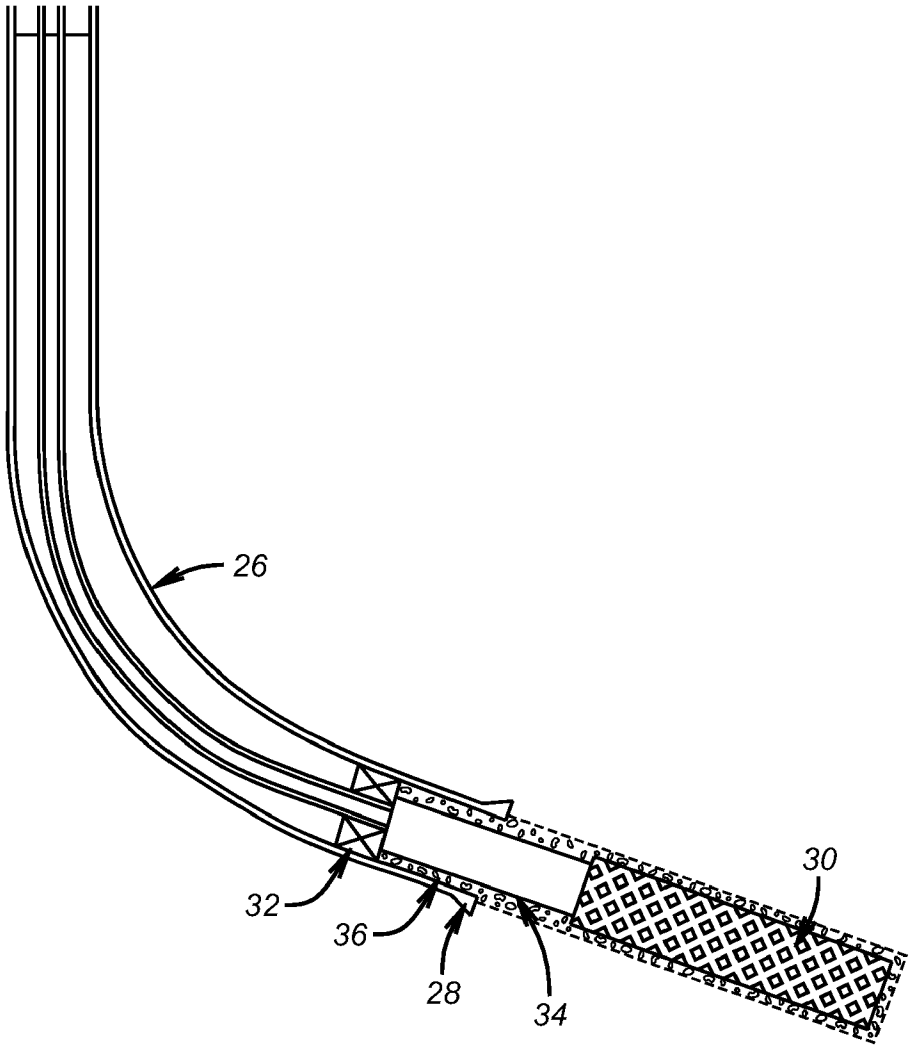
FIG. 4 shows the gun or guns inserted into the cement before it sets up and the displacement of the cement above the casing shoe and around the liner that supports the gun or guns.

FIG. 4 shows the work string 24 now supporting a hanger 32 followed by a liner 34 and then the gun assembly 30. The gun assembly 30 has been advanced into the cement 20 and the top of the cement 36 is now around the outside of the liner 34 and preferably above the casing shoe 28 but short of the hanger 32. Note that the gun assembly 30 outside diameter could be as large as the drift diameter of the casing 26 with the open hole 22 under reamed to be larger than the drift diameter of the casing 26. Optionally, the cement 20 can go up to or above the hanger 32. It is preferable to set the hanger 32 after the gun assembly 30 is deployed in the desired position shown if FIG. 4. While the sealing material 36 is generally referred to as cement it can be a variety of different formulations that can be delivered and remain soft long enough to allow for delivery of the liner 34 and the gun assembly 30 below the liner 34 before setting up. After the liner hanger has been set and the work string retrieved a short distance, the casing 26 is circulated with preferably brine and the extent of the circulation need only extend to the region of the liner hanger. This allows the debris cleanup job to be completed faster to save time and money.

Figure 5:
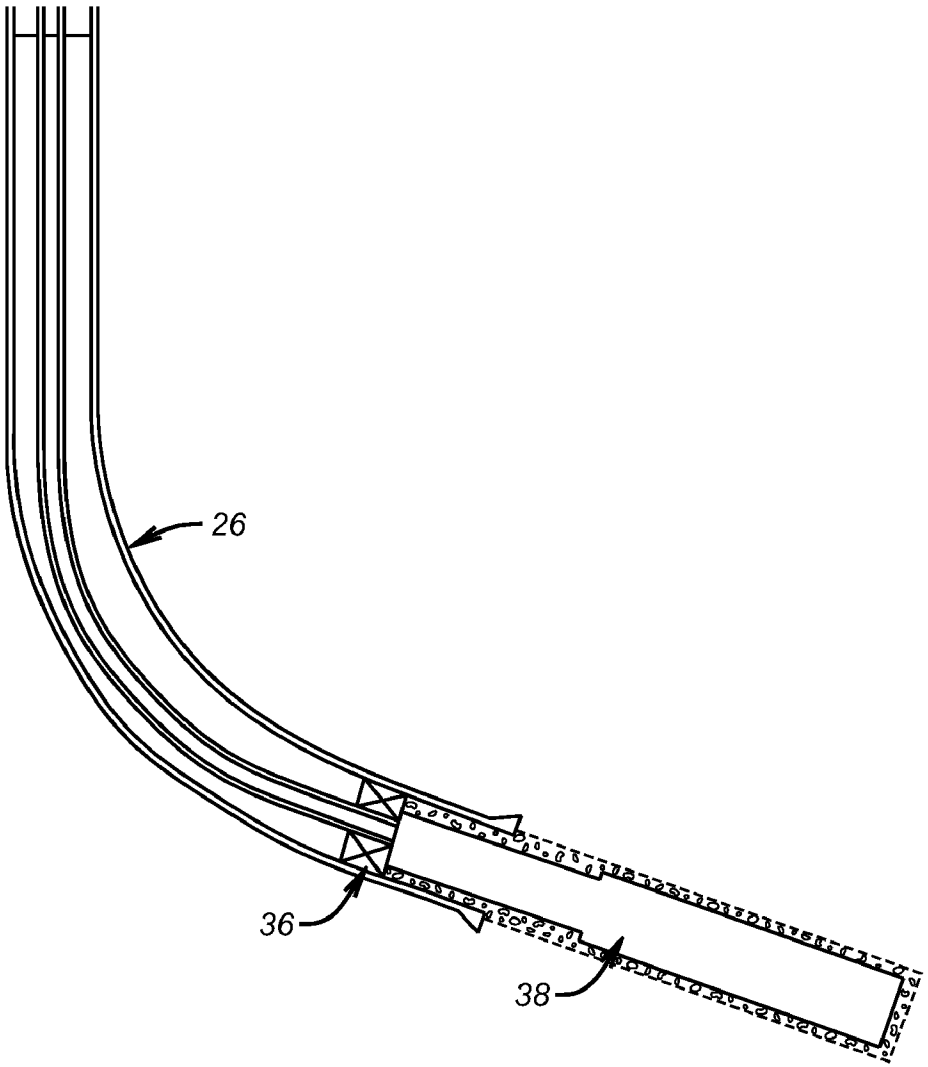
FIG. 5 shows the view of FIG. 4 with the gun or guns fired and their internals disintegrated to allow flow from a selected zone in the formation.

FIG. 5 illustrates the body 38 of the gun assembly 30 after the gun assembly 30 has been fired. The shot material in the gun body 38 can have compounds, such as zinc, to enhance disintegration of the residue from the explosive materials that penetrate the cement 22 and the surrounding formation without having to go through a surrounding tubular. The shot density and/or mass of the explosive material and its performance are enhanced because of the elimination of the space taken up by a tubular in the prior designs and the fact that the perforation no longer occurs through a thick tubular. The firing mechanisms can be a variety of designs known in the art. If the gun body is at atmospheric pressure prior to firing then this volume provides a surge chamber into which the formation fluids and/or gas can surge. This provides a clean up mechanism for the perforations. Wireline (electrical or mechanical) gun lengths are limited by a surface lubricator length or the load capacity of electric wireline and gun lengths well in excess of these restrictions are contemplated. For example the guns can be assembled into a downhole lubricator and run on tubing for even longer assemblies. This allows the whole interval to be shot under optimum conditions.

The above description is illustrative of the preferred embodiment and many modifications may be made by those skilled in the art without departing from the invention whose scope is to be determined from the literal and equivalent scope of the claims below.

I claim:

1. A wellbore completion method, comprising:
delivering a sealing material downhole;
placing at least one perforating gun into contact with said delivered sealing material;
perforating with said gun;
producing through said gun.

2. The method of claim 1, comprising:
delivering said sealing material into open hole.

3. The method of claim 2, comprising:
isolating a selected zone in said open hole with said sealing material.

4. The method of claim 2, comprising:
providing a sealed casing above said open hole;
supporting said gun with a tubular string that is securable to said casing with a hanger;
displacing said sealing material toward said hanger in an annular space around said tubular string.

5. The method of claim 4, comprising:
providing a shoe adjacent the lower end of said casing;
displacing said sealing material above said shoe due to insertion of said gun into said sealing material.

6. The method of claim 5, comprising:
circulating down, no further than adjacent the lower end of said hanger, a clean fluid to displace debris prior to delivery of said sealing material.

7. The method of claim 6, comprising:
perforating the wellbore by going through only said sealing material.

8. The method of claim 7, comprising:
increasing the gun size to take up at least some of the space made available by perforating in an open hole instead of in a cased hole.

9. The method of claim 8, comprising:
increasing shot density and/or explosive mass in said gun by taking up at least some of the space made available by perforating in an open hole instead of a cased hole.

10. The method of claim 4, comprising:
securing said tubular string with said hanger before perforating with said gun.

11. The method of claim 4, comprising:
providing an outer dimension on said gun to approach or be equal a drift diameter of said casing above the open hole.

12. The method of claim 1, comprising:
supporting said gun with a tubular string extending into open hole.

13. The method of claim 1, comprising:
allowing said sealing material to set before said perforating.

14. The method of claim 1, comprising:
providing a sealed casing above an open hole;
circulating down, no further than adjacent the lower end of said casing, a clean fluid to displace debris prior to delivery of said sealing material.

15. The method of claim 1, comprising:
perforating the wellbore by going through only said sealing material.

16. The method of claim 1, comprising:
increasing the gun size to take up at least some of the space made available by perforating in an open hole instead of in a cased hole.

17. The method of claim 16, comprising:
increasing shot density and/or explosive mass in said gun by taking up at least some of the space made available by perforating in an open hole instead of a cased hole.

18. The method of claim 1, comprising:
using the gun housing as a flow conduit after said perforating.

19. The method of claim 1, comprising:
assembling said perforating gun to a length that is longer than a surface lubricator length associated with the wellbore or a weight that exceeds the load capacity of an electric wireline or other cable for downhole use.

20. The method of claim 1, comprising:
providing charges in said perforating gun that are in zinc rings that are pinned together;
disintegrating said zinc rings after firing said perforating gun;
leaving a production passage through said gun due to said disintegrating.

* * * * *